US007026544B2

(12) United States Patent
Van Kempen

(10) Patent No.: US 7,026,544 B2
(45) Date of Patent: Apr. 11, 2006

(54) RF SYSTEM FOR AN MRI APPARATUS, PROVIDED WITH BEAD-SHAPED SPACERS

(75) Inventor: Dick Van Kempen, Nuenen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 51 days.

(21) Appl. No.: 10/498,729

(22) PCT Filed: Dec. 18, 2002

(86) PCT No.: PCT/IB02/05627

§ 371 (c)(1),
(2), (4) Date: Jun. 15, 2004

(87) PCT Pub. No.: WO03/054891

PCT Pub. Date: Jul. 3, 2003

(65) Prior Publication Data

US 2005/0103513 A1 May 19, 2005

(30) Foreign Application Priority Data

Dec. 20, 2001 (EP) ..... 01205049

(51) Int. Cl.
*H01B 7/00* (2006.01)

(52) U.S. Cl. ..... 174/28; 174/111

(58) Field of Classification Search ..... 174/28, 174/111

See application file for complete search history.

(56) References Cited

U.S. PATENT DOCUMENTS

| | | | | |
|---|---|---|---|---|
| 320,229 | A * | 6/1885 | Delany | 174/98 |
| 459,385 | A * | 9/1891 | Libbey | 174/111 |
| 937,435 | A * | 10/1909 | Guay | 174/111 |
| 2,086,629 | A * | 7/1937 | Mead | 333/243 |
| 5,796,044 | A | 8/1998 | Cobian et al. | |
| 5,834,699 | A | 11/1998 | Buck et al. | |

FOREIGN PATENT DOCUMENTS

| | | |
|---|---|---|
| CH | 192668 | 8/1937 |
| GB | 959503 | 6/1964 |

* cited by examiner

*Primary Examiner*—Chau N. Nguyen
(74) *Attorney, Agent, or Firm*—Thomas M. Lundin

(57) ABSTRACT

RF connection cable 2 for interconnecting an RF coil and an RF processing apparatus in an RF system of a medical MRI apparatus. The connection cable 2 is comprised of an outer sleeve 6 enclosing an inner cable comprising RF conductors 24, an inner sleeve 20 and a shield 22. Between the inner sleeve 20 and the outer sleeve 6 a plurality of spacers in the form of large beads 12-*i* alternating with small beads 14-*i* are provided. In this way, a very flexible cable is obtained having comparatively low dielectric losses and a low capacitive coupling with the patient.

14 Claims, 1 Drawing Sheet

RF SYSTEM FOR AN MRI APPARATUS, PROVIDED WITH BEAD-SHAPED SPACERS

BACKGROUND

The invention relates to an RF system for use in a medical MRI apparatus, provided with an RF coil and an RF connection cable connected to said RF coil, which connection cable comprises a number of RF conductors and a number of spacers in the form of drilled-through beads which are provided around said RF conductors and into which the RF conductors extend through the drilled holes in the spacers.

In a medical MRI apparatus, movable RF coils are used for receiving RF signals generated in the tissue of a patient to be examined. Said RF coils are connected, via an RF connection cable, to the RF processing equipment of the MRI apparatus in order to transfer the RF signals induced in the RF coil to said equipment. It is a well-known phenomenon that under certain conditions the signals passing through these RF conductors may be harmful to the patient, in particular cause burns, if the RF connection cable extends close to the skin of the patient.

Swiss patent specification No. 192668 discloses a high-frequency cable wherein an RF conductor is surrounded by a number of bead-shaped spacers, which are spaced apart and rigidly provided on the RF conductor. RF cables for medical MRI applications often require a plurality of conductors, for example four, as a result of which rigidly attaching the spacers to all RF conductors is complicated.

SUMMARY

It is an object of the invention to provide an RF connection cable for use in a medical MRI apparatus, which connection cable can be manufactured in a simple manner. For this purpose, the RF system in accordance with the invention is characterized in that the RF connection cable is provided with an outer sleeve, and the bead-shaped spacers have alternately a first dimension and a second dimension.

By providing an outer sleeve, the RF connection cable is made suitable for medical applications and, in particular, any direct contact between a part of the patient's body and the RF conductors is precluded. By providing alternately larger and smaller bead-shaped spacers, the cable obtained is highly flexible as a result of which the ease of handling for the operating staff is improved. A first additional advantage is that RF conductors of a first RF cable cannot get close to RF conductors of another RF cable situated in the vicinity, so that the mutual electrical influence, if any, is small. A second additional advantage is that a part of the volume between the RF conductors and the outer sleeve is formed by air, as a result of which the dielectric losses in the intermediate space are smaller than they would be in a situation where this space is entirely filled with the material of the spacers. In addition, the capacitive coupling between the patient's body and the RF conductors is reduced thereby, so that the risk of so-termed "hot spots" on the patient's body at locations where it contacts the connection cable is reduced, and image artefacts in these locations are counteracted.

In a preferred embodiment of the invention, the bead-shaped spacers are made of polyoxymethylene or of polycarbonate. By virtue thereof, the effect of the above-described low electrical losses, low capacitive coupling and reduction of image artefacts is optimized.

In another embodiment of the invention, the outer sleeve is provided with a smooth outside surface. In addition, the outer sleeve may be made of a biocompatible and biostable synthetic resin. By virtue thereof, the cable can be readily cleaned and is excellently suited for medical applications.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

The invention will be described hereinafter with reference to the Figures, wherein corresponding parts are indicated by means of the same reference numerals. In the drawings.

DETAILED DESCRIPTION

Figure 1:
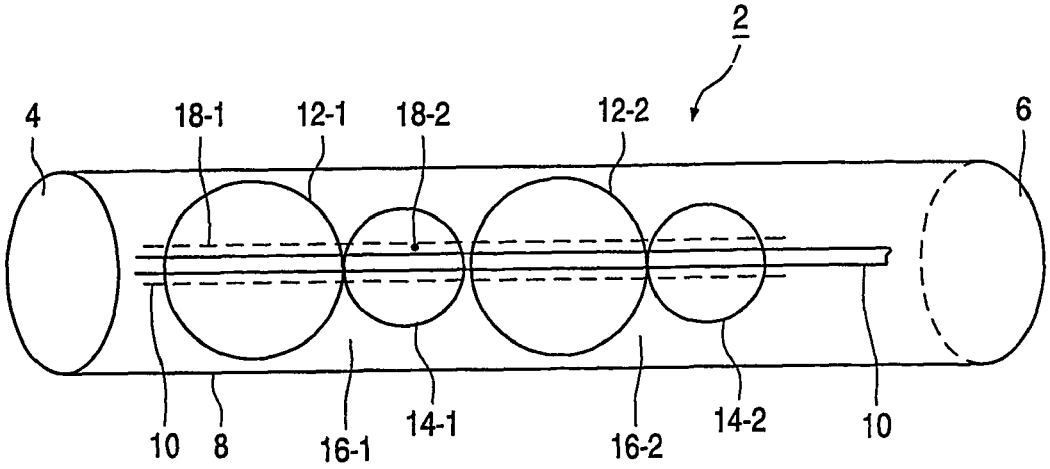
FIG. 1 diagrammatically shows an RF connection cable in accordance with the invention.

FIG. 1 diagrammatically shows an RF connection cable in accordance with the invention. The RF connection cable 2 is used in an RF system, which RF system is comprised of at least one RF coil, at least one RF connection cable per coil and RF processing equipment. The RF connection cable 2 is used to connect the RF coil (not shown in the Figure) for use in a medical MRI apparatus to the RF processing equipment of said MRI apparatus. To this end, the RF coil is connected to one end 4 and the RF processing equipment (not shown) is connected to the other end 6 with the help of customary connectors.

The outside of the connection cable 2 is formed by an outer sleeve 8 with a smooth outside surface enabling said cable to be readily cleaned. The material from which the outer sleeve 8 is made is preferably biocompatible and biostable, i.e. it must not react with tissue of the patient to be examined or be influenced itself by said tissue. A material which can suitably be used for this purpose is PVC, which can be obtained, in a form suitable for this purpose, from the firm of Adolf Damerius, Schrobenhausen, Germany.

A number of RF conductors, diagrammatically indicated by means of an interrupted line 10, is accommodated in the interior of the RF connection cable 2. Between the RF conductors 10 and the outer sleeve 8, a number of bead-shaped spacers 12-1, 12-2 . . . **12-*i* . . . are provided having a first external dimension, which is comparatively large in this case, for example 12 mm. Between these spacers 12-*i* there is provided a number of bead-shaped spacers 14-1, 14-2 . . . 14-*i* . . . having a different external dimension, which is comparatively small in this case, for example 8 mm. The spacers 14-*i* and the spacers 12-*i* are alternately arranged. In this manner, a high degree of flexibility of the RF connection cable 2 is achieved; in addition, a number of cavities 16-1, 16-2 . . . which are not filled with dielectric material are formed in this manner, as a result of which the dielectric losses and undesirable capacitive couplings are reduced. The bead-shaped spacers 12-*i* and 14-*i* are all provided with a hole 18-1, 18-2 through which the RF conductors 10** are fed.

The material from which the bead-shaped spacers **12-*i* and 14-*i*** are made is preferably polyoxymethylene (POM) or polycarbonate, which materials are light and tenacious, i.e. they have a favorable influence on the ease of handling and the strength of the cable, while they do not cause the image produced by the MRI apparatus to be disturbed.

Figure 2:
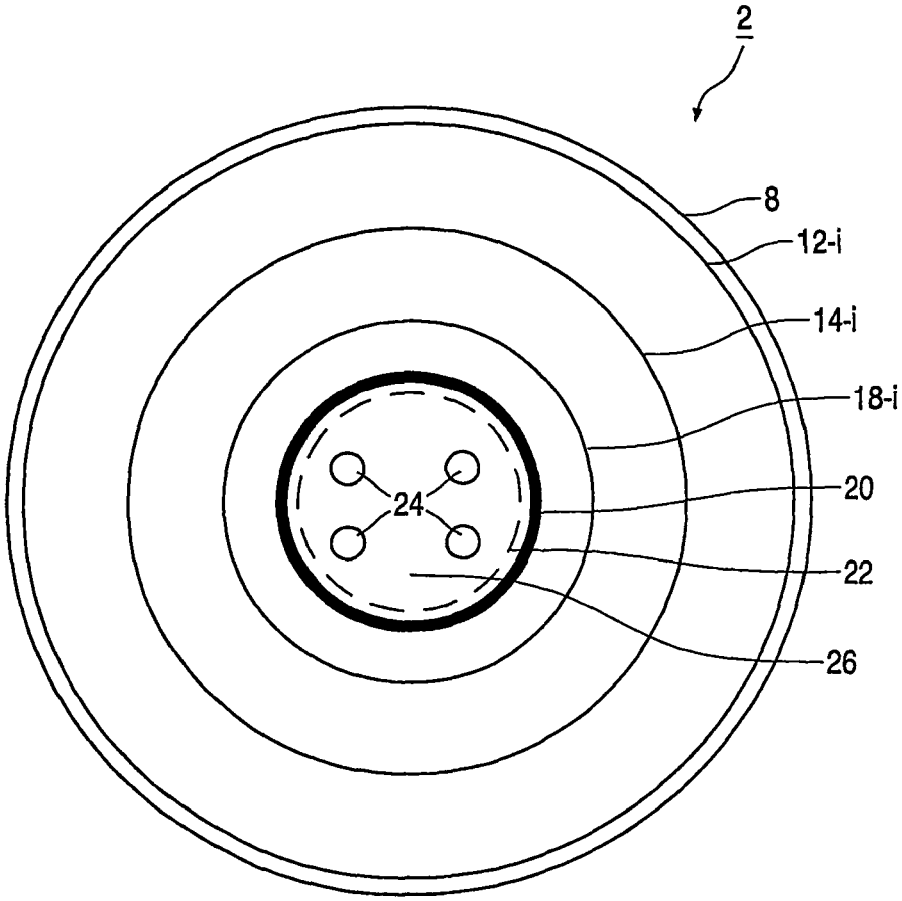
FIG. 2 is a cross-sectional view of the RF connection cable in accordance with the invention.

FIG. 2 is a cross-sectional view of the RE connection cable 2 in accordance with the invention. Inside the outer sleeve 8 comparatively large bead-shaped spacers 12-*i* are provided which alternate with comparatively small bead-shaped spacers 14-1, which spacers are all provided with a hole 18-*i*. Through the holes an inner cable is provided which is comprised of (from the outside inwards, successively) a synthetic resin (PVC) inner sleeve 20, an electrical RF shield 22 of, for example, copper and four RF conductors 24; the space between the RF conductors 24 within the shield 22 is filled with a suitable material 26 for, inter alia, strain relief, for example a combination of fabric and synthetic resin. The assembly of inner sleeve and all parts accommodated therein is commercially available as an assembled cable from the firm of Ernst & Engbring, Oer-Erkenschwick, Germany.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. An RF system for use in a medical MRI apparatus, provided with an RF coil and an RF connection cable connected to said RF coil, which RF connection cable comprises:

a plurality of RF conductors;

an RF shield surrounding the plurality of conductors;

a plurality of spacers in the form of drilled-through beads provided around said RF shield, the RF conductors and the RF shield extending through drilled holes in the bead-shaped spacers, the bead-shaped spacers having alternately a first dimension and a second dimension;

an outer sleeve provided around the spacers.

2. An RF system as claimed in claim 1, wherein the bead-shaped spacers are made of polyoxymethylene or of polycarbonate.

3. An RF system as claimed in claim 1, wherein the outer sleeve is provided with a smooth outside surface.

4. An RF system as claimed in claim 3, wherein the outer sleeve is made of a biocompatible and biostable synthetic resin.

5. An RF connection cable for use in an RF system for a medical MRI apparatus, as defined in claim 1.

6. An RF system as claimed in claim 1, wherein the bead-shaped spacers are made of a material with low dielectric losses, with low capacitive coupling, and which reduces MR image artifacts.

7. An RF system as claimed in claim 1 further including:

a dielectric material disposed inside the RF shield and around the RF conductors.

8. An RF system as claimed in claim 7, further including:

a resin sleeve between the RF shield and the bead-shaped spacers.

9. A magnetic resonance imaging system including the RF connection cable as claimed in claim 1 connecting a movable RF coil with other components of the magnetic resonance imaging system and providing an RF communication link therebetween.

10. An RF cable which extends closely adjacent a patient to connect an MRI apparatus with a movable RF coil, the RF coil tending to couple capacitively with the patient and potentially causing burns, the RF cable comprising:

a plurality of RF conductors encased in a dielectric material;

an RF shield surrounding the RF conductors;

a plurality of beads of a material that reduces capacitive coupling, the beads having holes through which the RF shield and conductors are threaded;

a smooth biocompatible sheath surrounding the beads, the beads being of a plurality of sizes such that air gaps are defined between the beads and the sheath to reduce the capacitive coupling with the patient.

11. An RF cable as claimed in claim 10, further including:

an insulating sleeve surrounding the RF shield.

12. An RF cable as claimed in claim 11, wherein the bead-like holes have a larger diameter than the insulating sleeve.

13. In combination a movable RF coil and an RF cable as claimed in claim 10.

14. A magnetic resonance imaging system including:

a movable RF coil;

an RF cable as claimed in claim 10 connecting the RF coil with the magnetic resonance imaging system.

* * * * *